US006066443A

United States Patent [19]

Dobles et al.

[11] Patent Number: 6,066,443

[45] **Date of Patent: *May 23, 2000**

[54] BLUE SENSITIZING DYES WITH HETEROCYCLIC SUBSTITUENTS

[75] Inventors: Thomas Robert Dobles, Hilton; Richard Lee Parton, Webster; Pamela McCue Ferguson, Farmington; Nona Veith Spitzner, Bergen; David Alan Stegman, Churchville; Steven George Link, Rochester; Kenneth Joseph Reed, Rochester; Marian Sue Henry, Rochester, all of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/680,894

[22] Filed: Jul. 16, 1996

Related U.S. Application Data

[63] Continuation of application No. 08/245,336, May 18, 1994, abandoned.

[51] Int. Cl.[7] ..... G03C 1/14; G03C 1/18

[52] U.S. Cl. ..... 430/583; 430/578; 430/581

[58] Field of Search ..... 430/578, 581, 430/583

[56] References Cited

U.S. PATENT DOCUMENTS

| | | | |
|---|---|---|---|
| 2,278,461 | 4/1942 | Middleton | 430/578 |
| 2,304,112 | 12/1942 | Middleton | 430/578 |
| 3,044,875 | 7/1962 | Götze | 430/578 |
| 3,084,045 | 4/1963 | Götze et al. | 430/578 |
| 3,541,089 | 11/1970 | Heseltine et al. | 260/240.65 |
| 3,560,208 | 2/1971 | Fumia et al. | 96/1.6 |
| 3,592,653 | 7/1971 | Fumia et al. | 96/101 |
| 3,598,603 | 8/1971 | Chapman | 96/130 |
| 3,615,609 | 10/1971 | Fry et al. | 96/104 |
| 3,632,349 | 1/1972 | Shiba et al. | 96/123 |
| 3,660,085 | 5/1972 | Depoorter et al. | 96/1.7 |
| 3,764,338 | 10/1973 | Depoorter et al. | 96/101 |
| 3,836,370 | 9/1974 | Beretta et al. | 96/127 |
| 4,035,190 | 7/1977 | Beretta et al. | 430/578 |
| 4,119,466 | 10/1978 | Van Allan et al. | 96/115 |
| 4,434,226 | 2/1984 | Wilgus et al. | 430/567 |
| 4,657,846 | 4/1987 | Kokubo et al. | 430/434 |
| 4,800,154 | 1/1989 | Okazaki et al. | 430/570 |
| 4,921,781 | 5/1990 | Takamuki et al. | 430/496 |
| 4,925,780 | 5/1990 | Yoshizawa et al. | 434/589 |
| 5,006,455 | 4/1991 | Patzold et al. | 430/571 |
| 5,135,845 | 8/1992 | MacIntyre et al. | 430/585 |
| 5,316,904 | 5/1994 | Parton et al. | 430/567 |
| 5,418,126 | 5/1995 | Stegman et al. | 430/583 |

FOREIGN PATENT DOCUMENTS

| | | | |
|---|---|---|---|
| 0 301 508 | 7/1988 | European Pat. Off. . | |
| 0 358 187 | 6/1989 | European Pat. Off. . | |
| 0 317 886 | 11/1989 | European Pat. Off. . | |
| 0 599 383 | 11/1993 | European Pat. Off. . | |
| 0 599 384 | 11/1993 | European Pat. Off. . | |
| 1 480 882 | 5/1966 | France . | |
| 1 063 028 | 8/1959 | Germany . | |
| 0147673 | 4/1981 | Germany | 430/592 |
| 1 454 644 | 11/1976 | United Kingdom . | |

OTHER PUBLICATIONS

US application No. 08/246,390,—Dye Compounds and Photographic Elements Containing Such Dyes, Parton et al.

US application No. 08/183,454—Furan or Pyrrole Substituted Dye Compounds and Silver Halide Photographic Elements Containing Such Dyes, Stegman et al.

Chemical Abstracts, vol. 105, No. 16, Oct. 20, 1986, Columbus, Ohio, US; abstract No. 143607a. p. 655; column 2.

Research Disclosure, No. 362, Jun. 1994 Havant GB, pp. 291–303, 'Photographic Multilayer Elements'. *p. 303–304.

*Primary Examiner*—Thorl Chea
*Attorney, Agent, or Firm*—Edith A. Rice

[57] ABSTRACT

A photographic element having a silver halide emulsion spectrally sensitized to blue light by a dye of formula (I) to have a maximum blue sensitivity at less than 485 nm. The dye allows the element to have good color reproduction while still providing good speed response despite the shorter blue sensitivity. Formula (I) is:

(I)

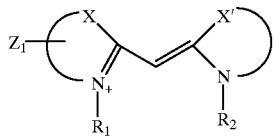

A wherein:

X and X' each independently represent the atoms necessary to complete a thiazole, benzothiazole, naphthothiazole, oxazole, benzoxazole, naphthoxazole, selenazole, benzoselenazole, naphthoselenazole, imidazole, benzimidazole, or naphtho-imidazole, and X may be further substituted and X' substituted or unsubstituted;

$Z_1$ represents a pyrrole, furan or thiophene containing group;

$R_1$ and $R_2$ each independently represent substituted or unsubstituted hydrocarbon containing 1 to 10 carbon atoms; and A represents a counter-ion as needed to balance a charge of the molecule.

31 Claims, No Drawings

BLUE SENSITIZING DYES WITH HETEROCYCLIC SUBSTITUENTS

This is a Continuation of application Ser. No. 08/245,336, filed May 18, 1994, now abandoned.

FIELD OF THE INVENTION

This invention relates to silver halide photographic elements with a silver halide emulsion sensitized by a blue sensitizing dye with an aromatic heterocyclic substituent to provide good speed and improved color reproduction.

BACKGROUND OF THE INVENTION

Silver halide photography usually involves the exposure of a silver halide photographic element with light in order to form a latent image that is developed during photographic processing to form a visible image. Silver halide is intrinsically sensitive only to light in the blue region of the spectrum. In order to sensitize the silver halide to other than the blue region, sensitizing dyes are used in the silver halide emulsion. Sensitizing dyes are chromophoric compounds (usually cyanine dye compounds). Their usual function is to adsorb to the silver halide and to absorb light (usually other than blue light) and transfer that energy via an electron to the silver halide grain thus rendering the silver halide sensitive to radiation of a wavelength other than the blue intrinsic sensitivity. However, sensitizing dyes can also be used to augment the sensitivity of silver halide in the blue region of the spectrum.

Most modern color photographic printing papers employ silver halide emulsions having a high chloride content in order to obtain rapid processing rates relative to silver bromide emulsions. The composition of these silver halide emulsions is usually AgClBr, where the percentage of bromide is very low, typically around 0.5% to 5%, and usually about 1%. The presence of small proportions of bromide enhances photoefficiency of the silver chloride emulsions and enhances the adsorption of sensitizing dyes to the emulsion surface while still allowing for rapid processing. However, even with small amounts of bromide present, some sensitizing dyes do not adsorb well to these emulsions resulting in poor spectral sensitization.

Color printing papers usually consist of at least three emulsions that are sensitized to blue, green and red light. Proper sensitization can be achieved by employing an appropriate sensitizing dye in each layer. Most common color photographic printing papers have a blue layer with a sensitizing dye that has a maximum sensitivity at about 480 nm.

Color photographic printing paper is intended to generate a print from a photographic color negative. An important quality characteristic of color paper or any color photographic element (including negatives) is color reproduction. Color reproduction is the ability to accurately portray the colors, or, more precisely, the hues of the original scene. It is known that using an emulsion in photographic elements which is blue sensitized with a dye to have a maximum sensitivity below 480 nm and low sensitivity at 480 nm, can lead to better color reproduction. This, and the importance of specific red and green sensitizations was described some time ago in U.S. Pat. No. 3,672,898. Subsequent patent publications such as U.S. Pat. No. 5,180,657 and US statutory invention registration H1243 describe color reproduction advantages with maximum blue sensitizations lying in various ranges which are below 480 nm.

However, the present inventors realized that using a shorter blue sensitizing dye can result in a speed loss. For color paper, one reason for this is that the energy output of the exposing device in many color paper printers decreases with decreasing wavelength in the blue region. Also, blue sensitive dyes have lower oscillator strengths than green or red sensitive dyes, resulting in relatively lower light absorption. Thus, providing blue sensitizing dyes with higher speeds, even for silver halide emulsions in color negative and color reversal elements, helps overcome this inherent deficiency.

Thus it would be desirable to provide a photographic element with a blue sensitized emulsion sensitized with a dye to have a maximum blue sensitivity at less than about 485 nm (particularly less than 480 nm) in order to obtain good color reproduction but which would still provide good speed.

SUMMARY OF THE INVENTION

The present invention then, aims to provide photographic elements with a blue sensitivie emulsion sensitized with a dye so as to enable good color reproduction while still having good speed. This is achieved by a photographic element having a silver halide emulsion spectrally sensitized to blue light by a dye of formula I to have a maximum blue sensitivity at less than 485 nm (or more preferably less than 480 nm):

(I)

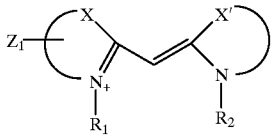

A wherein:

X and X' each independently represent the atoms necessary to complete a thiazole, benzothiazole, naphthothiazole, oxazole, benzoxazole, naphthoxazole, selenazole, benzoselenazole, naphthoselenazole, imidazole, benzimidazole, or naphtho-imidazole, and X may be further substituted and X' substituted or unsubstituted;

$Z_1$ represents a pyrrole, furan or thiophene containing group;

$R_1$ and $R_2$ each independently represent substituted or unsubstituted hydrocarbon containing 1 to 10 carbon atoms; and A represents a counter-ion as needed to balance a charge of the molecule.

DESCRIPTION OF PREFERRED EMBODIMENTS

The dye of formula (I) may be selected such that the emulsion is provided with a maximum blue senstivity which can even be less than 475 nm. Also, X and X' do not both simultaneously represent napthothiazole or napthoselenazole rings. Further, preferably X and X' do not represent the combination of a thiazole, benzothiazole, selenazole or benzoselenazole, with a napthothiazole or napthoselenazole. Optionally, X and X' may be selected so that they do not represent benzoselenazole, naphthoselenazole, benzothiazole or naphthiazole. Further optionally, they may be selected so that neither is naphthoselenazole or benzoselenazole. As mentioned, X and X' may be further substituted. Any substituents on the dye, particularly on X and X', other than $Z_1$, may optionally be limited to non-aromatic substituents (that is, they may optionally exclude substituents such as phenyl, pyrrole, thiophene, pyridine, and furan).

As to $Z_1$, this may in particular be directly appended to the benzo or naphtho ring of X (that is, directly bonded thereto with no intervening atoms) although optionally various linking groups such as carbonyl, amide or carbamoyl, alkyl or alkenyl linking groups may be used. Such linking groups could include suitable linking groups from those disclosed in pending U.S. patent applications Ser. No. 08/183,454 (filed Jan. 19, 1994) and Ser. Nos. 07/978,569, 07/978,567, and 07/978,589 (the latter three all filed on Nov. 19, 1992), each of which applications is incorporated herein in its entirety by reference. Examples of $Z_1$ include the following (which may be optionally substituted) where the free bond shown is the bond to the benzo or naphtho ring of X:

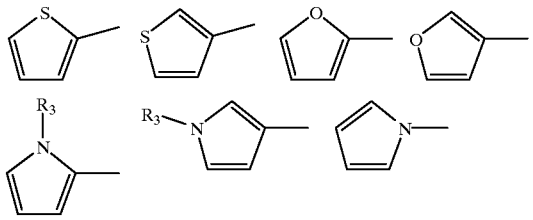

where R3 is hydrogen, substituted or unsubstituted alkyl (such as methyl, ethyl or 2-hydroxyethyl), a substituted or unsubstituted alkenyl, or a substituted or unsubstituted aryl (such as phenyl or 4-hydroxyphenyl). $Z_1$ could optionally be any aromatic heterocyclic substituent, particularly when $Z_1$ is directly appended to the benzo or naphtho ring of X.

The dye of formula (I) may particularly have at least one acid or acid salt substituent. Examples of acid or acid salt substituents include a sulfo or carboxy groups (particularly a sulfoalkyl) or —$CH_2$—CO—NH—$SO_2$—$CH_3$. At least one of $R_1$ or $R_2$, or both of them, may be substituted or unsubstituted lower alkyl (by "lower" is meant of 1–8 carbon atoms) or substituted or unsubstituted alkyl of from 1 to 4 carbon atoms. Both of $R_1$ and $R_2$ (particularly when both are substituted or unsubstituted lower alkyl) may be substituted by an acid or acid salt groups. Thus, either or both $R_1$ and $R_2$ could be, for example, 3-sulfobutyl, 3-sulfopropyl or 2-sulfoethyl, and the like.

A represents a counterion as necessary to balance the charge of the dye molecule. Such counterions are well-known in the art. Examples include sodium, potassium, triethylammonium, and the like.

Particular dyes of formula (I) may include those of formula (II) and (III) below:

(II)

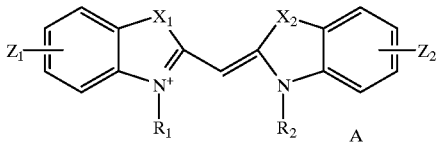

wherein in formula (II):

$X_1$ and $X_2$ independently represent O, S, Se, or $R_4N$— where $R_4$ is a substituted or unsubstituted alkyl, alkenyl, or aryl;

$Z_1$ represents a substituted or unsubstituted pyrrole, furan or thiophene as already described, which is directly appended to the benzo ring shown;

$Z_2$ represents H, any of those substituents which $Z_1$ can represent and which is directly appended to the benzo ring shown, or a substituted or unsubstituted lower alkyl, substituted or unsubstituted alkenyl or alkoxy (particularly lower alkenyl or alkoxy), halogen (particularly Cl or F), substituted or unsubstituted aryl, aryloxy, or thioalkyl, or any other substituent, and either benzene ring shown can be further substituted or not; and $R_1$, $R_2$ and A have been described above in connection with formula (I);

(III)

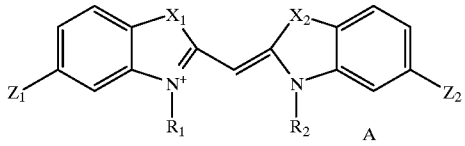

wherein $X_1$, $X_2$, $Z_1$, $Z_2$, $R_1$ and $R_2$ are described above but with at least one of $R_1$ or $R_2$ being a substituted or unsubstituted alkyl or aryl (preferably lower alkyl), at least one of which has an acid or acid salt substituent.

In formula (II) or (III), as mentioned in connection with formula (I), $Z_1$ could optionally be any aromatic heterocyclic substituent, particularly when $Z_1$ is directly appended to the benzo ring shown in those formulae. Similarly, such could be the case for $Z_2$ also since it may include any of those groups which $Z_1$ represents.

In formula (II) or (III) $X_1$ and $X_2$ may optionally be selected so that one of them is other than S or Se, or even such that when one is Se the other is not Se or S. In formula (II) or (III), any substituents on the dye molecule other than $Z_1$ may optionally be non-aromatic. In particular, any substituents on the benzo rings shown may optionally be non-aromatic.

Substituents for X and/or X' or the benzene rings in any of formula II or III, may include halogen (for example, chloro, fluoro, bromo), substituted or unsubstituted alkoxy (for example, methoxy, ethoxy), substituted or unsubstituted alkyl (for example, methyl, trifluoromethyl, benzyl), amides, alkoxycarbonyl, and other known substituents, and substituted and unsubstituted aryl (for example, phenyl, 5-chlorophenyl), or aryloxy (for example, phenoxy) substituted or unsubstituted thioalkyl (for example, methylthio or ethylthio), hydroxy or substituted or unsubstituted alkenyl (for example, vinyl, or styryl) and others known in the art. However, substituents on the benzo or naphtho rings in formulae (I), (II) or (III) do not include other fused aromatic rings. Thus, formulae (I) dyes can only have benzo or naphtho groups in X and X', while formulae (II) and (III) dyes cannot include naphtho groups such as naphthoxazole, napthothiazole, and the like.

Examples of particular blue sensitizing dyes of formula (I) used in photographic elements of the present invention are listed below in Table I but the present invention is not limited to the use of those dyes.

TABLE I

Invention Dyes

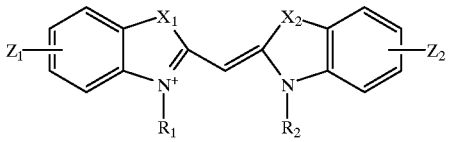

| Dye | $X_1$ | $X_2$ | $Z_1$ | $Z_2$ | $R_1$, $R_2$[a] |
|---|---|---|---|---|---|
| I-1 | O | S | 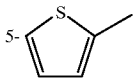 | 4,5-Benzo | SP, SP |
| I-2 | O | S | 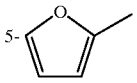 | 4,5-Benzo | SP, SP |
| I-3 | O | S | 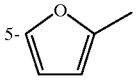 | 5-Cl | SP, SP |
| I-4 | S | S | 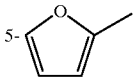 | 5-Cl | SP, SP |
| I-5 | S | S | 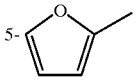 | =$Z_1$ | SP, SP |
| I-6 | S | O | 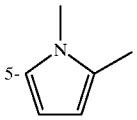 | 5-Cl | SP, SP |
| I-7 | O | O | 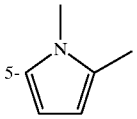 | 5-Cl | SP, SP |
| I-8 | S | S | 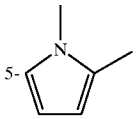 | 5-Cl | SP, SP |
| I-9 | S | S | 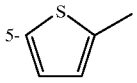 | 5-Cl | 3SB, SP |
| I-10 | S | S | 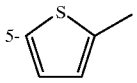 | 5-F | 3SB, 3SB |
| I-11 | S | S | 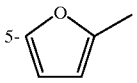 | =$Z_1$ | 3SB, 3SB |
| I-12 | S | S | 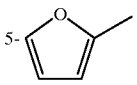 | =$Z_1$ | SP, Et |

TABLE I-continued

Invention Dyes

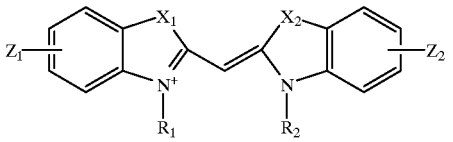

| Dye | $X_1$ | $X_2$ | $Z_1$ | $Z_2$ | $R_1$, $R_2$[a] |
|---|---|---|---|---|---|
| I-13 | O | S | 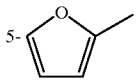 | =$Z_1$ | SP, SP |
| I-14 | S | O | 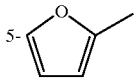 | 5-Phenyl | SP, SP |
| I-15 | S | S | 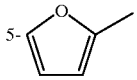 | 5-F | SP, SP |
| I-16 | S | S | 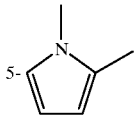 | 5-F | SP, SP |
| I-17 | O | S | 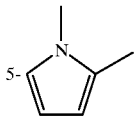 | 4,5-Benzo | SP, SP |
| I-18 | S | S | 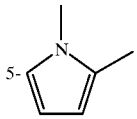 | =Z1 | SP, SP |
| I-19 | O | O | 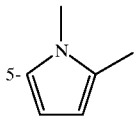 | =Z1 | SP, SP |
| I-20 | O | O | 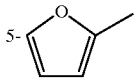 | =Z1 | SP, SP |

[a]SP is 3-sulfopropyl, 3SB is 3-sulfobutyl

Dye precursors can be made by techniques that are well-known in the art. For a review of the synthesis of substituted pyrroles see, G. P. Bean, Pyrroles, R. A. Jones, Ed., John Wiley & Sons, Inc., New York, 1990, Chapter 2. For a review of furan synthesis see, F. M. Dean, *Advances in Heterocyclic Chemistry,* A. R. Katritzky, Ed., vol. 30, Academic Press, New York, 1982, p 167.

For example, a pyrrol-1-yl substituted base can be made by reaction of an amino base with 2,5-dimethoxytetrahydrofuran.

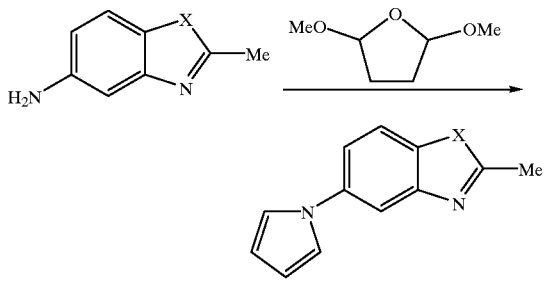

Preparation of a diazonium salt from an amino-substituted base followed by decomposition in the presence of furan results in formation of the furan-2-yl substituted base.

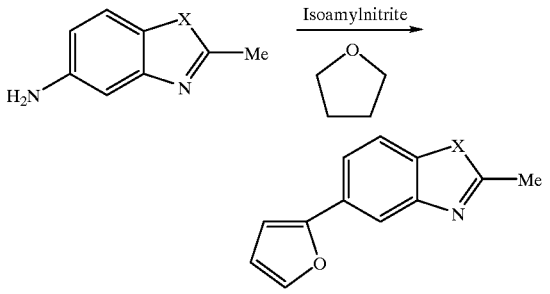

Preparation of a diazonium salt from an amino-substituted base followed by decomposition in the presence of thiophene results in formation of the thiophene-2-yl substituted base.

Dyes of formula I can be prepared according to techniques that are well-known in the art, such as described in Hamer, *Cyanine Dyes and Related Compounds,* 1964 (publisher John Wiley & Sons, New York, N.Y.) and *The Theory of the Photographic Process,* T. H. James, editor, 4th Edition, Macmillan, New York, 1977.

The amount of sensitizing dye that is useful in the invention may be from 0.001 to 4 millimoles of dye per mole of silver halide, but is preferably in the range of 0.01 to 1.0 millimoles of dye per mole of silver halide. Optimum dye concentrations can be determined by methods known in the art.

The invention can be practiced with silver halide emulsions as generally known in the art, for example silver bromide, silver chloride, silver bromoiodide, silver chlorobromide and the like. However, emulsions useful for color photographic printing paper will be high chloride emulsions for reasons discussed in the Background. That is the silver halide used in color paper photographic elements of the present invention preferably contains at least 90% silver chloride or more (for example, at least 95%, 98%, 99% or 100% silver chloride). Some silver bromide may be present. Preferably if there is any iodide present it constitutes less than 2 mole % of all halide (although this may even be less than 1.5, 1, 0.5 or 0.1 mole %). In particular, the possibility is also contemplated that the silver chloride could be treated with a bromide source to increase its sensitivity, although the bulk concentration of bromide in the resulting emulsion will typically be no more than about 2 to 2.5% and preferably between about 0.5 to 1.5% (or even 0.5 to 1.0%) the remainder being silver chloride. The foregoing % figures are mole %.

The emulsions can be either non-tabular grain or tabular grain emulsions, where tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions, that is emulsions wherein ECD/t>8, where ECD is the diameter of a circle having an area equal to grain projected area and t is tabular grain thickness; intermediate aspect ratio tabular grain emulsions, that is ECD/t=5 to 8; or low aspect ratio tabular grain emulsions, that is ECD/t=2 to 5. The emulsions typically exhibit high tabularity (T), where $T=ECD/t^2$, that is $ECD/t^2>25$, and ECD and t are both measured in micrometers ($\mu$m). The emulsion can further have a tabularity of >40 or even >100 or >1000. The tabular silver halide emulsions for the blue sensitive layer preferably have a tabularity of from 25 to 4000, and more preferably from 100 to 1500).

The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultrathin (<0.07 $\mu$m) tabular grains being contemplated for maximum grain surface to volume ratios.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated by Wey U.S. Pat. No. 4,399,215, Maskasky U.S. Pat. Nos. 4,400,463, 4,684,607, 4,713,320, 4,713,323, 5,061,617, 5,178,997, 5,178,998, 5,183,732, 5,185,239, 5,217,858 and 5,221,602, Wey et al U.S. Pat. No. 4,414,306, Daubendiek et al U.S. Pat. Nos. 4,414,310, 4,672,027, 4,693,964 and 4,914,014, Abbott et al U.S. Pat. No. 4,425,426, Solberg et al U.S. Pat. No. 4,433,048, Wilgus et al U.S. Pat. No. 4,434,226, Kofron et al U.S. Pat. No. 4,439,520, Sugimoto et al U.S. Pat. No. 4,665,012, Yagi et al U.S. Pat. No. 4,686,176, Hayashi U.S. Pat. No. 4,748,106, Goda U.S. Pat. No. 4,775,617, Takada et al U.S. Pat. No. 4,783,398, Saitou et al U.S. Pat. Nos. 4,797,354 and 4,977,074, Tufano U.S. Pat. No. 4,801,523, Tufano et al U.S. Pat. No. 4,804,621, Ikeda et al U.S. Pat. No. 4,806,461 and EPO 0 485 946, Bando U.S. Pat. No. 4,839,268, Makino et al U.S. Pat. No. 4,853,322, Nishikawa et al U.S. Pat. No. 4,952,491, Houle et al U.S. Pat. No. 5,035,992, Piggin et al U.S. Pat. Nos. 5,061,609 and 5,061,616, Nakamura et al U.S. Pat. No. 5,096,806, Bell et al U.S. Pat. No. 5,132,203, Tsaur et al U.S. Pat. Nos. 5,147,771, '772, '773, 5,171,659, 5,210,013 and 5,252,453, Jones et al U.S. Pat. No. 5,176,991, Maskasky et al U.S. Pat. No. 5,176,992, Black et al U.S. Pat. No. 5,219,720, Antoniades et al U.S. Pat. No. 5,250,403, Zola et al EPO 0 362 699, Maruyama et al EPO 0 431 585, Urabe EPO 0 460 656, Verbeek EPO 0 481 133, 0 503 700 and 0 532 801, Jagannathan et al EPO 0 515 894 and Sekiya et al EPO 0 547 912. Emulsions containing {100} major face tabular grains are illustrated by Bogg U.S. Pat. No. 4,063,951, Mignot U.S. Pat. No. 4,386,156, Maskasky U.S. Pat. Nos. 5,264,337 and 5,275,930, Brust et al EPO 0 534 395 and Saitou et al EPO 0 569 971.

The silver halide grains to be used in the invention may be prepared according to methods known in the art, such as those described in *Research Disclosure I* and James, *The Theory of the Photographic Process,* or U.S. Pat. No. 4,439,520 for precipitation of iodobromide tabular grains (these references and all other references cited herein are incoporated in their entirety by reference to them). These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with compounds such as gold sensitizers (e.g., gold and sulfur) and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as illustrated in *Research Disclosure,* June 1975, item 13452 and U.S. Pat. No. 3,772,031.

The silver halide may be sensitized by dyes of Formula I by methods known in the art, such as described in *Research Disclosure I.* The compounds may be added to an emulsion of the silver halide grains and a hydrophilic colloid at any time prior to (e.g., during or after chemical sensitization) or simultaneous with the coating of the emulsion on a photographic element. The sensitizing dye of formula (I) may be added before and/or during a high temperature step (that is, at least at 50° C. or at least at 60° C.). The resulting sensitized silver halide emulsion may be mixed with a dispersion of color image-forming coupler immediately before coating or in advance of coating (for example, 2 hours). Essentially any type of emulsion (e.g., negative-working emulsions such as surface-sensitive emulsions of unfogged internal latent image-forming emulsions, direct-positive emulsions such as surface fogged emulsions, or others described in, for example, *Research Disclosure I*) may be used. The above-described sensitizing dye of Formula I can be used alone, or may be used in combination with other sensitizing dyes, e.g. to also provide the silver halide with sensitivity to wavelengths of light outside the blue region or, to broaden sensitization within the blue region, for anti-fogging properties, or for other purposes as known in the art. As an example of broadening light sensitivity in the blue region, a dye of formula I which provides a wavelength of maximum sensitivity on the emulsion at less than 440 nm (or alternatively, 450 nm) can be used with a dye which provides a maximum sensitivity at greater than about 460 nm (or even 450 nm). Note that the foregoing sensitivities are the values provided by each dye individually.

Other addenda in the emulsion may include antifoggants, stabilizers, filter dyes, light absorbing or reflecting pigments, vehicle hardeners such as gelatin hardeners, coating aids, dye-forming couplers (typically dispersed in a water-immiscible solvent), and development modifiers such as development inhibitor releasing couplers, timed development inhibitor releasing couplers, and bleach accelerators. These addenda and methods of their inclusion in emulsion and other photographic layers are well-known in the art and are disclosed in *Research Disclosure I* and the references cited therein. The emulsion may also include brighteners, such as stilbene brighteners.

The emulsion layer containing silver halide sensitized with a dye of formula (I) as described above, can be coated simultaneously or sequentially with other emulsion layers, subbing layers, filter dye layers, interlayers, or overcoat layers, all of which may contain various addenda known to be included in photographic elements. These include antifoggants, oxidized developer scavengers, DIR couplers, antistatic agents, optical brighteners, light-absorbing or light-scattering pigments, and the like. The layers of the photographic element can be coated onto a support using techniques well-known in the art. All of these can be coated on a support which can be transparent or reflective (for example, a paper support). These techniques include immersion or dip coating, roller coating, reverse roll coating, air knife coating, doctor blade coating, stretch-flow coating, and curtain coating, to name a few. The coated layers of the element may be chill-set or dried, or both. Drying may be accelerated by known techniques such as conduction, convection, radiation heating, or a combination thereof.

Photographic materials of the present invention can be black and white photographic elements but are preferably color photographic elements. A color photographic element generally contains three silver emulsion layers or sets of layers (each set of layers often consisting of emulsions of the same spectral sensitivity but different speed): a blue-sensitive layer having a yellow dye-forming color coupler associated therewith; a green-sensitive layer having a magenta dye-forming color coupler associated therewith; and a red-sensitive layer having a cyan dye-forming color coupler associated therewith. Those dye forming couplers are provided in the emulsion typically by first dissolving or dispersing them in a water immiscible, high boiling point organic solvent, the resulting mixture then being dispersed in the emulsion. Suitable solvents include those in European Patent Application 87119271.2. Dye-forming couplers are well-known in the art and are disclosed, for example, in *Research Disclosure I.*

Photographic elements of the present invention may also usefully include a magnetic recording layer as described in *Research Disclosure,* Item 34390, November 1992.

Photographic elements of the present invention are preferably imagewise exposed using any of the known techniques, including those described in *Research Disclosure I,* section XVIII. This typically involves exposure to light in the visible region of the spectrum.

Of course, in the case of photographic paper (that is photographic elements with paper support), these will normally be exposed in a printer in a known manner from light which passed through a photographic negative.

Photographic elements comprising the composition of the invention can be processed in any of a number of well-known photographic processes utilizing any of a number of well-known processing compositions, described, for example, in *Research Disclosure I,* or in James, *The Theory of the Photographic Process* 4th, 1977. Examples include KODAK PROCESS C-41 process or KODAK PROCESS E-6. Such processing further includes rapid processing of the type described in, for example, U.S. Pat. No. 4,892,804. Examples include KODAK PROCESS RA-4 process or KODAK PROCESS RA-100.

The invention is described further in the examples below. Comparison dyes used are in the following examples are listed in Table II below.

TABLE II

Comparison Dyes[3]

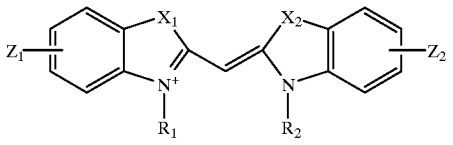

| Dye | $X_1$ | $X_2$ | $Z_1$ | $Z_2$ | $R_1$, $R_2$[a] |
|---|---|---|---|---|---|
| C-1 | S | S | Cl | 4,5-Benzo | SP, SP |
| C-2 | S | S | " | 5-Phenyl | " |
| C-3 | S | O | 5-Phenyl | 4,5-Benzo | " |
| C-4 | S | S | " | 5-Phenyl | " |
| C-5 | S | S | " | 5-F | " |
| C-6 | O | S | " | 5-Cl | " |
| C-7 | O | O | " | 5-Phenyl | " |

[a]SP is 3-sulfopropyl

EXAMPLE 1

Synthesis of Dye I-8

Intermediate A: 5-(Pyrrol-1-yl)-2-methylbenzothiazole: 5-Amino-2-methylbenzothiazole (30.0 g, 0.203 mol) and 2,5-dimethoxytetrahydrofuran (27.0 g, 0.204 mol) were combined with 90 mL of acetic acid and the solution was heated at reflux for 1 hr. The mixture was evaporated to a dark slurry and purified by column chromatography. This afforded 16.3 g (39% yield) of product, m.p. 91–96° C.

Anal Calcd for: $C_{12}H_{10}N_2S$: C, 67.26; H, 4.70; N, 13.07. Found: C, 67.29; H, 4.74; N. 12.95.

Intermediate B: Anhydro-5-(pyrrol-1-yl)-2-methyl-3-(3-sulfopropyl)benzothiazolium hydroxide: 5-(Pyrrol-1-yl)-2-methylbenzothiazole (15.0 g, 0.07 mol) was combined with 1,3-propanesultone (12.8 g, 0.105 mol) and 25 mL of butyronitrile and heated at reflux for 5.5 hrs. The solid formed was collected and washed with acetone and dried affording 17.2 g of product (73% yield).

Preparation of Anhydro-5-chloro-5'-(pyrrol-1-yl)-3,3'-di(3-sulfopropyl)thiacyanine hydroxide triethylammonium salt (Dye I-8): Anhydro-5-(pyrrol-1-yl)-2-methyl-3-(3-sulfopropyl)benzothiazolium hydroxide (3.4 g, 10 mmol) was combined with anhydro-5-chloro-2-(N-hydroxyaminomethylene)-3-(3-sulfopropyl) benzothiazolium hydroxide (3.35 g, 10 mmol), acetic anhydride (3 mL), acetic acid (100 mL) and triethylamine (5 mL) and heated at 65–70 ° C. for 15 min. The mixture was diluted with ethyl ether and the solid was collected and recrystallized three times from pyridine/water and then from 400 mL of methanol containing 10 mL of triethylamine. This afforded 0.85 g (12% yield) of dye; l-max=434 nm (MeOH), e-Max $9.85\times10^4$.

Anal Calcd for: $C_{31}H_{39}ClN_4O_6S_4$—$0.5H_2O$: C, 50.52; H, 5.43; N, 7.60. Found: C, 50.49; H, 5.71; N, 7.66.

EXAMPLE 2

To illustrate the improved color reproduction that can be obtained by using a blue sensitizing dye which provides an emulsion with a shorter wavelength of maximum blue sensitivity, a photographic element was constructed. The following layers were coated in order on a paper support (in order, from the support, of layers 1 to 7):

Layer 7. Overcoat layer: Gelatin (1.1 g/m$^2$).

Layer 6. UV absorbing layer: A mixture of hydroxyphenylbenzotriazoles (0.32 g/m$^2$), oxidized developer scavenger (0.043g/m$^2$), and gelatin (0.63 g/m$^2$).

Layer 5. Red sensitive layer: Chemically and red spectrally sensitized monodisperse AgClBr (low % Br) negative emulsion (0.21 g Ag/m$^2$) and cyan-dye forming coupler A (0.42 g/m$^2$) in di-n-butyl phthalate coupler solvent (0.21 g/m$^2$), and gelatin (1.1 g/m$^2$).

Layer 4. UV absorbing layer: A mixture of hydroxyphenylbenzotriazoles (0.32 g/m$^2$), oxidized developer scavenger (0.043 g/m$^2$), and gelatin (0.63 g/m$^2$).

Layer 3. Green sensitive layer: Chemically and green spectrally sensitized monodisperse AgClBr (low % Br) negative emulsion (0.27 g Ag/m$^2$) and magenta-dye forming coupler B (0.39 g/m$^2$) in di-n-butyl phthalate coupler solvent (0.15 g/m$^2$), and gelatin (1,2 g/m$^2$).

Layer 2. Interlayer: Oxidized developer scavenger (0.09 g/m$^2$), and gelatin (0.75 g/m$^2$).

Layer 1. Blue sensitive layer: Chemically and blue spectrally sensitized monodisperse 0.78 um cubic AgClBr (0.5% Br) negative emulsion (0.24 g Ag/m$^2$) and yellow-dye forming coupler C (1.1 g/m$^2$) in di-n-butyl phthalate coupler solvent (0.27 g/m$^2$), and gelatin (1.5 g/m$^2$).

Support: A paper stock consisting of a mixture of hard and soft wood pulp extrusion overcoated with a titanium dioxide and zinc oxide pigmented poyethylene layer.

The layers 1–7 were hardened with bis(vinylsulfonyl)methyl ether at 1.9% of the total gelatin weight.

Coupler identifications are:

A=cyan dye-forming coupler: (2-(alpha-(2,4-di-tert-amylphenoxy)-butyramido-4,6-dichloro-5-ethyl phenol.

B=magenta dye-forming coupler: 1-(2,4,6-trichlorophenyl)-3-(2-chloro-5-(alpha-(4-hydroxy-3-tert-butylphenoxy) tetradecanoamido)anilino)-5-pyrazolone.

C=yellow dye-forming coupler: alpha(4-(4-benzyloxyphenylsulfonyl)phenoxy)-alpha-(pivalyl)-2-chloro-5-(gamma-(2,4-di-tamylphenoxy)butyramido) actanilide.

Four different color photographic printing papers were created this way, which differed in the blue spectral sensitizing dye employed. The conventional example contained C-1, whereas the examples which demonstrate improved color reproduction contain C-2, C-4, or I-1. In each case, the dye was coated at a level of $2.6\times10^{-4}$ moles of dye per mole of silver.

After exposure, the paper was processed according to KODAK Process RA-4 (a standard paper process).

The papers were evaluated to determine their respective ability to reproduce colors throughout the visible spectrum accurately. The improvement was demonstrated by taking a conventional color-negative photograph of a MacBeth Color Checker, and printing it from the negative onto the four different samples of paper described above—each of which contained a different blue sensitizing dye. The printer used was a KODAK Model 312 color printer, equipped with a KODAK Digital Printer Controller.

Color reproduction was evaluated as follows: the CIE L*a*b* system locates the particular hue of an object in two-dimensional space, where the two dimensions are a* and b*. An object having no color would have a*=0 and b*=0, and could be represented by a point at the origin in this two-dimensional space; that is, at (a*,b*)=(0,0). Any colored object would be located at some point other than the origin, i.e. (a*,b*)=(m,n). The hue of the object is then described in this space by the angle between the a* axis in the region of positive a*, and a line drawn from the origin through the point (m,n).

In this example, hue angles for the 18 colored patches of an actual MacBeth Color Checker (MCC) were calculated from CIE L*a*b* measurements obtained by scanning the colored patches with a reflectance spectrophotometer, and processing the reflectance data with algorithms disclosed in the following references by R. W. G. Hunt. The MacBeth Color Checker is a well-known tool which is described in the article "A Color Rendition Chart", by C. S. McCamy, H. Marcus, and J. G. Davidson (Journal of Applied Photographic Engineering, Vol. 2, No. 3, Summer 1976, pages 95–99). The Commission Internationale de l'Eclairage (CIE) color measurement system "CIE L*a*b*", or "CIELAB", is another well-known tool. It is described in the texts *Measuring Colour* R. W. G. Hunt, 1987, and *The Reproduction of Colour in Photography, Printing, and Television, 4th. Ed.,* also by R. W. G. Hunt (published by Ellis Horwood Limited, Chichester, West Sussex, England). Then, similar CIE L*a*b* measurements were made on the 18 color patches appearing on each of the four color prints made on the four color paper samples containing the various dyes. Again, the hue angles for the photographic reproductions of the 18 colored MCC patches were calculated. Finally, the absolute value of the hue angle deviations from the actual MCC were obtained. That is, for each of the 18 color patches reproduced by each of the four papers, the absolute value of the difference between the actual MCC hue angle and the reproduced MCC hue angle was determined. The angles were arbitrarily defined, and measured in radians, but this does not affect the size of the angular deviations. These data are shown in Table III.

Table III. Demonstration of Overall Color Reproduction Enhancement Based on a MacBeth Color Checker.*

TABLE III

Demonstration of Overall Color Reproduction Enhancement Based on a MacBeth Color Checker*

| Patch | C-1 | C-2 | C-4 | I-1 |
|---|---|---|---|---|
| 1 | 0.00811 | 0.00969 | 0.06956 | 0.02331 |
| 2 | 0.27463 | 0.26570 | 0.29270 | 0.37897 |
| 3 | 0.33013 | 0.26585 | 0.27406 | 0.20224 |
| 4 | 0.00335 | 0.18756 | 0.17395 | 0.20699 |
| 5 | 0.33998 | 0.32264 | 0.28430 | 0.29245 |
| 6 | 0.48318 | 0.43432 | 0.44976 | 0.54273 |
| 7 | 0.13780 | 0.12261 | 0.14869 | 0.14167 |
| 8 | 0.20952 | 0.14510 | 0.15230 | 0.13678 |
| 9 | 0.09000 | 0.02879 | 0.02766 | 0.01495 |
| 10 | 0.35845 | 0.29557 | 0.28298 | 0.24003 |
| 11 | 0.38204 | 0.44884 | 0.42986 | 0.45347 |
| 12 | 0.05252 | 0.02482 | 0.04964 | 0.03290 |
| 13 | 0.08884 | 0.03188 | 0.00532 | 0.02381 |
| 14 | 0.22097 | 0.00125 | 0.00045 | 0.05693 |
| 15 | 0.19353 | 0.16040 | 0.19191 | 0.17514 |
| 16 | 0.12158 | 0.15755 | 0.14185 | 0.15716 |
| 17 | 0.07163 | 0.02667 | 0.02578 | 0.07199 |
| 18 | 0.04051 | 0.06011 | 0.03655 | 0.09107 |
| Sum | 3.40676 | 2.98936 | 3.03731 | 3.24255 |

*Data in columns are the absolute value of the hue angle deviation from the actual MacBeth Color Checker color patch hue angle.

As seen from Table III, the deviations are typically less for the hypsochromic dyes (that is, C-2, C-4, and I-1) than for C-1, and, in particular, the improvement is demonstrated by the sums of the 18 deviations for each of the four dyes: the sum of the deviations is less for each of the hypsochromic dyes than for C-1. This indicates an overall enhancement in color reproduction is obtained by the use of the hypsochromic dyes.

As can be seen from Table III and IV, the invention and comparison dyes C-2, C-3, and C-4 impart a maximum sensitivity to the emulsions at wavelengths significantly shorter than 480 nm which results in improved color reproduction relative to C-1. However, the use of the invention dyes results in less of a speed loss than their corresponding comparison analog dyes.

PHOTOGRAPHIC EVALUATION EXAMPLE 1

The dyes (Table IV) were coated at a level of $2.62\times10^{-4}$ moles/Ag on an aurous sulfide sensitized 0.78 micron silver chloride emulsion having the following coverages: silver (280 mg/m$^2$), gelatin (829 mg/m$^2$), 1-(3-acetamidophenyl)-5-mercaptotetrazole (68 mg/mole Ag), and potassium bromide (734 mg/mole Ag). The yellow coupler dispersion contained pentanamide, N-(5-((4-(2,4-bis(1,1-dimethylpropyl)phenoxy)-1-oxobutyl)amino)-2-chlorophenyl)-4,4-dimethy-3-oxo-2-(4((4-(phenylmethoxy)phenyl)sulfonyl)phenoxy) coupler (1076 mg/m$^2$), and gelatin (829 mg/m$^2$).

The coupler dispersion was added to the dye/silver chloride emulsion immediately before coating. The elements also included a gelatin overcoat layer (1.08 g/m$^2$) and a gelatin undercoat layer (3.23 g/m$^2$). The layers were coated on paper and hardened with bis(vinylsulfonyl)methyl ether at 1.7% of the total gelatin weight.

To evaluate photographic sensitivity, the elements were exposed to a light source designed to simulate a color negative print exposure. The elements were then processed with KODAK Process RA-4 (a standard paper process) through a Colenta processor. This consists of a color development (45 sec, 35° C.), bleach-fix (45 sec, 35° C.) and stabilization or water wash (90 sec, 35° C.) followed by drying (60 sec, 60° C.). The speed at 1.0 density units above Dmin is listed in Table IV.

TABLE IV

| Dye | Sens 1-max | Coating Set | Dye Speed | Dye Speed of C-1 | Relative Speed Loss |
|---|---|---|---|---|---|
| | | Photographic Results | | | |
| C-2 | 468 | A | 159 | 189 | −30 |
| I-8 | 470 | B | 191 | 201 | −10 |
| I-4 | 471 | B | 175 | 201 | −26 |
| C-3 | 454 | C | 145 | 189 | −44 |
| I-2 | 460 | B | 169 | 201 | −32 |
| I-1 | 460 | C | 152 | 189 | −37 |
| C-4 | 466 | A | 164 | 189 | −25 |

Note: Dyes designated with a "C" are comparative dyes.

Note: Dyes designated with a "C" are comparative dyes.

Note that dyes I-8 and I-4 are the same as C-2 except for replacement of the phenyl in C-2 with a pyrrole or furan in I-8 and I-4, respectively. Also, I-2 and I-1 are the same as C-3 except for replacement of the phenyl substituent in C-3 with furan and thiophene in I-2 and I-1, respectively.

Two things can be seen from the above table. First, replacing a phenyl group on a shorter blue dye such as C-2 or C-3, with a pyrrole, furan or thiophene, results in a dye which sensitizes the emulsion with a blue maximum sensitivity only a few nanometers different from the phenyl (and below 480 nm). This allows for good color reproduction relative to dyes such as C-1 which provide the emulsion with a maximum blue sensitivity at 480 nm. Second, and most importantly though, it is clear from the above table that the inventive dyes result in higher photographic speed (that is, lower Relative Speed Loss) than their respective phenyl-substituted analog comparative dyes.

PHOTOGRAPHIC EVALUATION EXAMPLE 2

A coating experiment was done exactly as described in the previous Photographic Evaluation Example 1, but with additional inventive dyes. Exposure and processing was also identical to the previous example. The structures of the comparative and inventive dyes, as well as the photographic speed resulting from the simulated color negative print exposure are shown in Table V below:

TABLE V

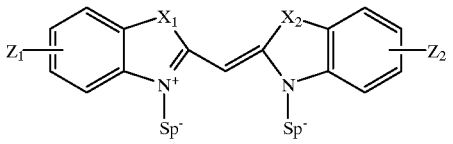

| Dye | X1 | X2 | Z1 | Z2 | Speed |
|---|---|---|---|---|---|
| C-1 | S | S | 4,5-Benzo | 5-Cl | 165 |
| I-18 | S | S | 5-Pyrrol-1-yl | =Z1 | 164 |
| I-5 | S | S | 5-Furan-2-yl | =Z1 | NA |
| C-4 | S | S | 5-Phenyl | =Z1 | 140 |
| I-8 | S | S | 5-Pyrrol-1-yl | 5-Cl | 156 |
| I-4 | S | S | 5-Furan-2-yl | 5-Cl | NA |
| C-2 | S | S | 5-Phenyl | 5-Cl | 131 |
| I-16 | S | S | 5-Pyrrol-1-yl | 5-F | 151 |
| C-5 | S | S | 5-Phenyl | 5-F | 137 |
| I-3 | O | S | 5-Furan-2-yl | 5-Cl | 124 |
| C-6 | O | S | 5-Phenyl | 5-Cl | 113 |
| I-19 | O | O | 5-Pyrrol-1-yl | =Z1 | 75 |
| C-7 | O | O | 5-Phenyl | =Z1 | 59 |

TABLE V-continued

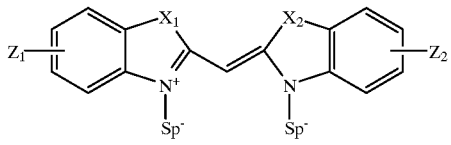

| Dye | X1 | X2 | Z1 | Z2 | Speed |
|---|---|---|---|---|---|

[a]SP is 3-sulfopropyl
NA not available

The data in Table V demonstrate that the inventive dyes have higher photographic speed than their comparative analogs. That is, if the phenyl substituent on a comparative dye is replaced by a substituent containing an aromatic heterocycle of the present invention the resulting dye still provides the emulsion with a maximum blue sensitization below 480 nm. However, the resulting dye with the furan, pyrrole, or thiophene substituent provides higher speed on the emulsion than the counterpart phenyl substituted dye.

PHOTOGRAPHIC EVALUATION EXAMPLE 3

Samples of a 0.78 micron cubic edge length silver chloride emulsion were optimally sensitized with a combination of sodium thiosulfate pentahydrate and aurous bis(1,4,5-trimethyl-1,2,4-triazolium-3-thiolate) (disclosed in U.S. Pat. No. 5,049,485) with heating by methods known to those skilled in the art, and spectrally sensitized using various comparative and inventive dyes at $2.62\times10^{-4}$ moles dye/Ag mol. The spectral sensitization was performed by two different methods for this example. The first method was to add the spectral sensitizing dye during the high-temperature (that is, at 60° C.) portion of the chemical sensitization process. This first method is referred to as "DIH". The second method was to add the spectral sensitizing dye before the high-temperature portion of the chemical sensitization process. Specifically, in the second method the dye was added at 40° C. about 15 minutes before raising the temperature. This second method is referred to as "DIF". Additionally, each sample contained 1-(3-acetamidophenyl)-5-mercaptotetrazole (82 mg/mole Ag), and potassium bromide (150 mg/mole Ag). The yellow coupler dispersion contained pentanamide, N-(5-((4-(2,4-bis(1,1-dimethylpropyl) phenoxy)-1-oxobutyl)amino)-2-(phenylmethoxy)phenyl) sulfonyl)phenoxy) coupler (1076 mg/m$^2$) in gelatin.

The sensitized emulsion and the coupler dispersion were combined immediately before coating on a paper support at a laydown of 280 mg Ag/m$^2$ and 1.66 g gelatin/m$^2$. The support contained a gelatin undercoat layer (3.23 g/m$^2$). A gelatin overcoat layer (1.08 g/m$^2$) was coated over the emulsion/coupler layer. The coatings were hardened with bis(vinylsulfonyl)methyl ether at 1.7% of the total gelatin weight.

The resulting coatings were exposed and processed as described in Photographic Evaluation Examples 1 and 2. The structures and photographic speed for the dyes tested in this example are shown in Table VI below.

TABLE VI

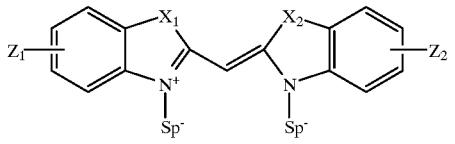

| Dye | X1 | X2 | Z1 | Z2 | DIH Speed | DIF Speed |
|---|---|---|---|---|---|---|
| C-1 | S | S | 4,5-Benzo | 5-Cl | 185 | 181 |
| I-8 | S | S | 5-Pyrrol-1-yl | 5-Cl | 167 | 150 |
| C-2 | S | S | 5-Phenyl | 5-Cl | 161 | 146 |
| I-3 | O | S | 5-Furan-2-yl | 5-Cl | 131 | 113 |
| C-6 | O | S | 5-Phenyl | 5-Cl | 124 | 108 |
| I-19 | O | O | 5-Pyrrol-1-yl | =Z1 | 76 | 66 |
| C-7 | O | O | 5-Phenyl | =Z1 | 57 | 44 |

The data in Table VI demonstrate that the inventive dyes have higher photographic speed than their comparative analogs. That is, if the phenyl substituent on a comparative dye is replaced by a substituent containing an aromatic heterocycle of the present invention, an increase in speed again results.

PHOTOGRAPHIC EVALUATION EXAMPLE 4

A 1.0 micron by 0.1 micron <100> $AgCl_{99.5}I_{0.5}$ tabular grain emulsion which contained 40 g. of gel per mole of silver was chemically and spectrally sensitized as follows: To 0.023 mole of emulsion was added an additional 21.4 g. of gel. The emulsion and gel were melted at 40 degrees C, then 0.9 mmole of a sensitizing dye per mole of silver was added from a methanol solution and held for 20 minutes at 40 degrees C. 2.0 mg sodium thiosulfate pentahydrate and 1.0 mg potassium tetrachloroaurate were added per mole of silver and the melt was heated to 60 degrees C at a rate of 1.67 degrees/min. After the melt was maintained at 60 degrees C for 15 min, it was cooled back to 40 degrees C at a rate of 1.67 degrees/min. 70 mg of m-acetamidophenylmercaptotetrazole was added per mole of silver and held at 40 degrees C for 15 min. Water was then added to dilute the melt to coating concentration. Samples 1 through 6 were prepared identically using the dyes listed in the table below.

Each spectrally sensitized emulsion sample was simultaneously coated with a common yellow dye-forming coupler dispersion melt containing dispersion A, dispersion B, and surfactants. The samples were coated on a 5 mil cellulose triacetate support that had been backed with a particulate carbon antihalation backing and subbed with 4.88 g/m$^2$. of gelatin. The emulsion and couplers were laid down at a level of 968 mg/m$^2$. silver, 484 mg/m$^2$ coupler Y-1, and 484 mg/m$^2$ coupler Y-2. Surfactants SF-1 (1%) and SF-2 (0.4%) were added as coating aids. The emulsion layer was overcoated with 1.08 g/m$^2$ gelatin and hardened with 1.75% bis-(vinylsulfonyl)methane based on total gelatin.

Dispersion A had the following composition: 9% by weight coupler Y-1, 6% by weight deionized gelatin, 0.44% surfactant SF-3, 1.1% 2N propionic acid.

Dispersion B had the following composition: 9% by weight coupler Y-2, 4.5% dibutyl phthalate, 6.5% gelatin, 0.6% surfactant SF-3, and adjusted to pH 5.1 with 2N propionic acid.

SF-1

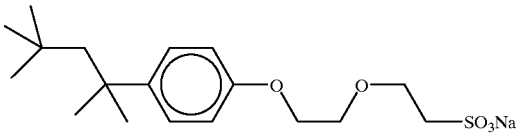

SF-2

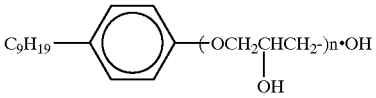

SF-3

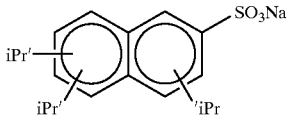

Y-1

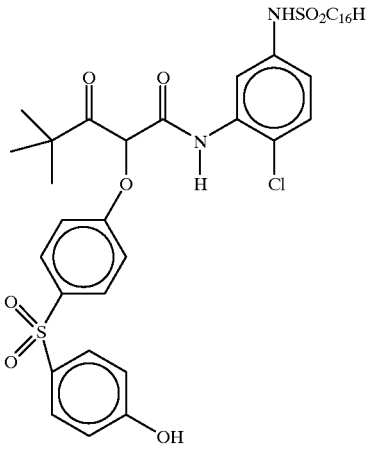

Y-2

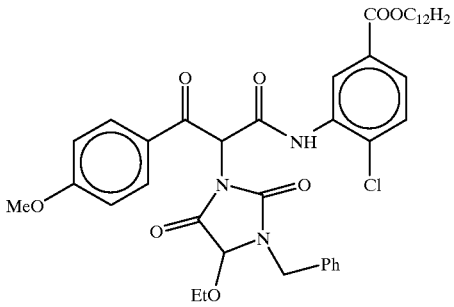

Strips from these coatings were given a 1/25" stepped wedge exposure from a 5500K light source through a WRATTEN® 2B filter. The samples were processed using KODAK FLEXICOLOR C41® process as described in *Brit. J. Photog. Annual* 1988, p196–198 with the exception that the composition of the bleach solution was changed to comprise propylenediaminetetraacetic acid. The minimum density was measured and the photographic speed determined as 100 times the log of the exposure required to give a density 0.15 above the minimum density.

A second strip from each coating was given a 1/50" stepped wedge exposure from the 365 nm line emission of a mercury lamp and processed as above.

To correct for differences in the extent of chemical finish induced by the dyes, the relative spectral sensitivity of the dyes was determined by subtracting the 365 nm line speed from the speed of the coating exposed with the WRATTEN® 2B filter and comparing each example to sample 1 for which the difference was given a value of 100. The results are listed in the Table VII.

TABLE VII

| Sample No. | Dye | Relative Sensitivity |
|---|---|---|
| 1 | C-2 | 100 |
| 2 | I-8 | 132 |
| 3 | I-16 | 126 |
| 4 | I-15 | 126 |
| 5 | C-4 | 141 |
| 6 | I-19 | 148 |

It can be seen again that when a dye of the invention with an aromatic heterocylic substituent is compared directly to a similar dye with a phenyl substituent, the dye of the invention provides increased blue sensitivity to the emulsion.

stepped exposure on a Type I-b sensitometer having a 5500K color temperature with UV light excluded by a KODAK WPATTEN 2B filter. Exposed coatings were processed through a standard six minute E-6 or E-6 REHALO process. Relative reversal threshold speeds were measured using the standard method in which the speed is related to that point on the exposure axis which is 0.2 below maximum density (dmax) if the slope of the curve were normalized to −1.0. The relative reversal image dmax or the rehalo dmin/dmax can taken as a measure of the relative emulsion fog.

The dye level remained fixed at 1.2 millimoles/silver mole as did the molar ratio of short to long (1:2) wavelength sensitizing dye.

From Table VIII, the magnitude of the speed advantage associated with this invention is readily apparent in both dyed and intrinsic exposures.

TABLE VIII

TABLE VIII

| DYE COMBINATIONS | 5000K exp and E-6 SPEED | DEVELOPMENT DMAX | 365 Hg LINE exp SPEED | and E-6 REHALODEVEL OPMENT PERCENT FOG |
|---|---|---|---|---|
| C-7 + DYE Z (COMPARITIVE) | 181 | 2.27 | 202 | 5.2 |
| I-22 + DYE Z (INVENTION) | 208 | 2.04 | 218 | 13.1 |

PHOTOGRAPHIC EVALUATION EXAMPLE 5

A substantial speed improvement is realized by the use of a short wavelength sensitizing (<440 nm) furyl substituted oxacarbocyanine dye as compared to the phenyl substituted dye. Such dyes may be advantageously used in combination (1:2 molar ratio) with a long wavelength (greater than about 460 nm) thiacarbocyanine spectral sensitizing dye.

Dyes used in the following examples were as follows:

C-7 5,5'-di-phenyl-N,N'-di-3-sulfopropyloxacyanine

I-20 5,5'-di-(2-furyl)-N,N'-di-3-sulfopropyloxacyanine

Dye Z 5-chloro-N,N'-di-3-sulfopropylthiacyanine

A reversal element was constructed as follows: A 2% bulk iodide tabular grain emulsion was prepared as described below, with dimensions of 1.40 um equivalent circular diameter by 0.15 um thick. It was optimally spectrochemically sensitized with 1.2 millimoles of a given dye or dye combination, 18.1 micromoles of sodium thiosulfate pentahydrate and 5.2 micromoles of potassium tetrachloroaurate dihydrate per mole of silver halide. Other adjuvants such as pseudo halide (SCN) salt were also used. Chemical activation of the sensitizers was effected through the use of a thermal heat cycle held for a predetemined time (0 to 15 min) at 65° C. or 5 to 10 min at 75° C. The times were chosen to give nearly matched fogs (or Dmax) in a standard 6 minute E-6 or E-6 REHALO process (British Journal of Photography Annual, 1982, pp 201–203) for the different spectral sensitizing dyes used. A mixture of sensitized emulsion and colloidal dispersion of a suitable dye-forming coupler (2-(2,4-bis(1,1-dimethylpropyl)phenoxy)-n-(4-((2,2,3,3,4,4,4-heptqafluoro-1-oxobutyl)amino)-3-hydroxyphenyl)-hexanamide), was coated using a gelatin vehicle on a clear acetate support with anithalation protection. Appropriate surfactants as required to obtain uniform coatings were employed in addition to gelatin crosslinking agents to harden the coated film. Dry coatings were given a The emulsion described above was prepared as follows. A stable population of AgBr nuclei representing 0.5% of the final precipitation was formed at 40 C during a one minute double jet nucleation at a pBr of 1.597. An accelerated double jet growth using 2 M silver and 2.75 M bromide then proceeded for an additional 60% of the precipitation at 70 C and the same pBr. At this point the pBr can either be increased to 3.48 (this pBr was actually used in this example) or else lowered to 0.9 after which 2 mole % silver iodide seeds are added to the reactor. The remainder of the precipitation is then conducted at the pBr just prior to the seed addition. The emulsion can be either iso-washed or ultra-filtered to remove unwanted salts.

While the invention has been described in detail with particular reference to preferred embodiments, it will be understood that variations and modifications can be effected within the spirit and scope of the invention.

What is claimed is:

1. A photographic element comprising a silver halide emulsion spectrally sensitized to blue light by a dye of formula I to have a maximum blue sensitivity at less than 485 nm:

(I)

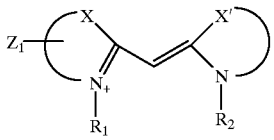

A wherein:

X and X' each independently represent the atoms necessary to complete a thiazole, benzothiazole, naphthothiazole, oxazole, benzoxazole, naphthoxazole, selenazole, benzoselenazole, naphthoselenazole, imidazole, benzimidazole, or naphtho-imidazole, and X may be further substituted and X' substituted or unsubstituted;

$Z_1$ represents a pyrrole containing group in which the pyrrole ring is directly appended to X;

$R_1$ and $R_2$ each independently represent substituted or unsubstituted hydrocarbon containing 1 to 10 carbon atoms; and A represents a counter-ion as needed to balance a charge of the molecule; with the proviso that any substituents on the dye, other than $Z_1$, are non-aromatic.

2. A photographic element according to claim 1 wherein the dye of formula (I) is such as to provide the emulsion with a maximum sensitivity at less than 480 nm, X represents the atoms necessary to complete a benzothiazole, naphthothiazole, benzoxazole, naphthoxazole, benzoselenazole, naphthoselenazole, benzimidazole, or naphtho-imidazole, and Z, is directly appended to the benzo or naphtho ring of X.

3. A photographic element according to claim 1, wherein one of $R_1$ and $R_2$ is substituted with an acid or acid salt group.

4. A photographic element according to claim 1 wherein the silver halide emulsion sensitized with the dye of formula (I) is at least 90 mole % silver chloride.

5. A photographic element according to claim 1 wherein the silver halide emulsion sensitized with the dye of formula (I) is at least 95 mole % silver chloride.

6. A photographic element according to claim 1 wherein X and X' are independently thiazole, benzothiazole or naphthothiazole.

7. A photographic element according to claim 1 additionally comprising a heterocyclic mercapto anti-foggant compound.

8. A photographic element according to claim 1 wherein the dye of formula (I) provides the emulsion with a maximum sensitivity of less than 440 nm, and wherein the emulsion sensitized by the dye of formula (I) is also sensitized with a second dye which provides a maximum sensitivity on the emulsion of greater than 460 nm.

9. A photographic element according to claim 8 wherein $Z_1$ is of formula:

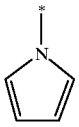

wherein the pyrrole ring shown may be substituted or unsubstituted, and * represents the position of bonding to the benzo ring shown in formula (III).

10. A photographic element according to claim 1 wherein the dye of formula (I) was added to the emulsion at a temperature of at least 60° C.

11. A photographic element according to claim 10 wherein $Z_1$ is of formula:

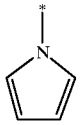

wherein the pyrrole ring shown may be substituted or unsubstituted, and * represents the position of bonding to the benzo ring shown in formula (III).

12. A photographic element according to claim 1 wherein $Z_1$ is of formula:

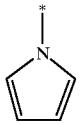

wherein the pyrrole ring shown is unsubstituted, and * represents the position of bonding to the remainder of the structure shown in formula (I).

13. A photographic element having a silver halide emulsion sensitized to blue light by a dye of formula (III) to have a maximum blue sensitivity at less than 485 nm:

(III)

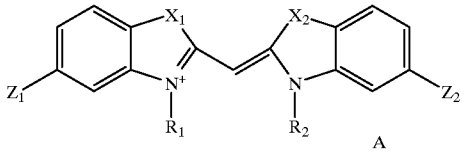

wherein:

$X_1$ and $X_2$ independently represent O, S, Se, or $R_4N$— where $R_4$ is a substituted or unsubstituted alkyl, alkenyl, or aryl;

$Z_1$ represents a substituted or unsubstituted pyrrole group in which the pyrrole ring is directly appended to the benzo group;

$Z_2$ is H or a nonaromatic substituent, and both benzene rings shown may be further substituted or not, provided that any further substituents on the dye are non-aromatic;

$R_1$ and $R_2$ represent a substituted or unsubstituted alkyl or aryl, at least one of which has an acid or acid salt substituent; and A is a counter-ion as needed to balance a charge of the molecule.

14. A silver halide photographic element according to claim 13 wherein the dye of formula (III) is such as to provide the emulsion with a maximum sensitivity at less than 480 nm.

15. A photographic element according to claim 13 wherein $Z_1$ is of formula:

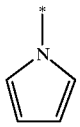

wherein the pyrrole ring shown may be substituted or unsubstituted, and * represents the position of bonding to the benzo ring shown in formula (III).

16. A photographic element according to claim 13 wherein the silver halide emulsion sensitized with the dye of formula (III) is at least 90 mole % silver chloride.

17. A photographic element according to claim 13 wherein the silver halide emulsion sensitized with the dye of formula (III) is at least 95 mole % silver chloride.

18. A photographic element according to claim 13 wherein both $R_1$ and $R_2$ are substituted with an acid or acid salt group.

19. A photographic element according to claim 18 wherein $Z_1$ is of formula:

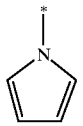

wherein the pyrrole ring shown may be substituted or unsubstituted, and * represents the position of bonding to the benzo ring shown in formula (III).

20. A photographic element according to claim 13 wherein $R_1$ and $R_2$ are both substituted with an acid or acid salt group and have from 1 to 4 carbon atoms.

21. A photographic element according to claim 13 wherein both $X_1$ and $X_2$ are S.

22. A photographic element having a silver halide emulsion sensitized to blue light by a dye of formula (III) to have a maximum blue sensitivity at less than 485 nm:

(III)

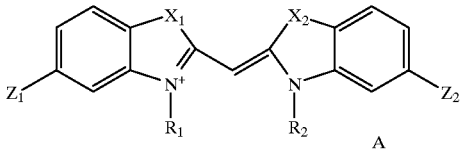

wherein:

$X_1$ and $X_2$ independently represent O, S, Se, or $R_4N$— where $R_4$ is a substituted or unsubstituted alkyl, alkenyl, or aryl;

$Z_1$ represents a substituted or unsubstituted furan group in which the furan ring is directly appended to the benzo ring;

$Z_2$ is selected from the group consisting of H, or a non-aromatic substituent, selected from substituted or unsubstituted lower alkyl, substituted or unsubstituted alkenyl or alkoxy, and halogen, and both benzene rings shown may be further substituted or not provided any further substituents on the dye shown are non-aromatic;

$R_1$ and $R_2$ represent a substituted or unsubstituted alkyl or aryl, at least one of which has an acid or acid salt substituent; and A is a counter-ion as needed to balance a charge of the molecule.

23. A photographic element according to claim 22 wherein the silver halide emulsion sensitized with the dye of formula (III) is at least 90 mole % silver chloride.

24. A photographic element according to claim 22, wherein the silver halide emulsion sensitized with the dye of formula (III) is at lease 95 mole % silver chloride.

25. A photographic element according to claim 22, wherein $X_1$ and $X_2$ are both S.

26. A silver halide photographic element according to claim 22, wherein the dye of formula (III) is such as to provide the emulsion with a maximum sensitivity at less than 480 nm.

27. A photographic element according to claim 22, wherein both $R_1$ and $R_2$ are substituted with an acid or acid salt group.

28. A photographic element according to claim 22, wherein $R_1$ and $R_2$ are both substituted with an acid or acid salt group and have from 1 to 4 carbon atoms.

29. A photographic element according to claim 22 additionally comprising a heterocyclic mercapto anti-foggant compound.

30. A photographic element according to claim 22 wherein the dye of formula (III) provides the emulsion with a maximum sensitivity of less than 440 nm, and wherein the emulsion sensitized by the dye of formula (I) is also sensitized with a second dye which provides a maximum sensitivity on the emulsion of greater than 460 nm.

31. A photographic element according to claim 22 wherein the dye of formula (III) was added to the emulsion at a temperature of at least 60° C.

* * * * *